US006936159B1

(12) United States Patent
Kean

(10) Patent No.: US 6,936,159 B1
(45) Date of Patent: Aug. 30, 2005

(54) PROCESS FOR RECOVERING HYDROCARBONS FROM A CARBON CONTAINING MATERIAL

(75) Inventor: Percy Evan Kean, Ravenswood (AU)

(73) Assignee: Add Astra Environment Technologies Pty Ltd, Victoria (AU)

( * ) Notice: Subject to any disclaimer, the term of this patent is extended or adjusted under 35 U.S.C. 154(b) by 316 days.

(21) Appl. No.: 10/111,830

(22) PCT Filed: Nov. 23, 2000

(86) PCT No.: PCT/AU00/01426

§ 371 (c)(1),
(2), (4) Date: Apr. 29, 2002

(87) PCT Pub. No.: WO01/40406

PCT Pub. Date: Jun. 7, 2001

(30) Foreign Application Priority Data

Nov. 30, 1999 (AU) ..... PQ4357

(51) Int. Cl.[7] ..... C10G 1/00; C10G 1/06

(52) U.S. Cl. ..... 208/403; 208/407; 208/415; 208/417; 208/420; 208/422; 208/428

(58) Field of Search ..... 208/403, 407, 208/415, 417, 420, 422, 428

(56) References Cited

U.S. PATENT DOCUMENTS

| | | | | |
|---|---|---|---|---|
| 2,119,647 | A * | 6/1938 | Mathias et al. | 208/423 |
| 3,917,800 | A * | 11/1975 | McGauley et al. | 423/244.06 |
| 4,202,757 | A * | 5/1980 | Amendola | 208/403 |
| 4,430,175 | A | 2/1984 | Kreysa et al. | 204/72 |
| 4,539,096 | A | 9/1985 | Rudnick | 208/11 |

FOREIGN PATENT DOCUMENTS

| | | |
|---|---|---|
| EP | 0152506 | 8/1985 |
| WO | WO01/40406 | 6/2001 |

OTHER PUBLICATIONS

European Patent Office, Supplementary European Search Report, Application No. EP 00 97 3642, 1 PAGE.

Pertwee RG: Pharmacology of Cannabinoid CB1 and CB2 Receptors, Pharmacology & Therapeutics, vol. 74, No. 2, 1997, pp. 129-180, XP002226467 Amsterdam.

* cited by examiner

*Primary Examiner*—Walter D. Griffin
*Assistant Examiner*—Tam M. Nguyen
(74) *Attorney, Agent, or Firm*—Andrus, Sceales, Starke & Sawall, LLP

(57) ABSTRACT

A process for recovering hydrocarbons from coal or oil shale is disclosed. The process involves the steps of forming a pulp of finely divided coal or oil shale in a first reaction bed, adding concentrated sulphuric acid to the first reaction bed, controlling the temperature of the first reaction bed to produce a hydrocarbon mixture, and deacidifying the hydrocarbon mixture.

13 Claims, 2 Drawing Sheets

PROCESS FOR RECOVERING HYDROCARBONS FROM A CARBON CONTAINING MATERIAL

CROSS-REFERENCE TO RELATED APPLICATIONS

This application is the U.S. national stage application of International Application PCT/AU00/01426, filed 23 Nov. 2000, which international application was published on 7 Jun. 2001, as International Publication WO 01/40406A1 in the English language. The International Application claims priority of Australian Patent Application No. PQ 4357 filed 30 Nov. 1999.

1. Field of the Invention

This invention relates to a process of convening a carbon coning material such as coal lignite, oil shale and the like carbon sources into a hydrocarbon mixture which is a suitable feedstock in the production of useable hydrocarbons such as gasoline and fuel oils.

2. Background of the Invention

The production of hydrocarbons, solids, liquids and gases, from mineral based carbonaceous materials such as coal and oil shale is generally produced in a retort process. This involves the heating of carbonaceous material in a reaction vessel to a temperature which is sufficient to destructively distil the volatile hydrocarbon components from the ash other inorganic residues contained in the coal or oil shale. The heat applied to the trial must be sufficient to free the volatile materials from the structure of the coal or oil shale particles and this excessive heat tends to result in cracking of the longer chain hydrocarbons. The gaseous cracked hydrocarbons recovered from the process must then be subjected to a hydro-reforming process requiring large volumes of hydrogen in order to produce a crude having the longer chain hydrocarbons distillable to produce useable liquids such as gasoline and fuel oils. Significant amounts of hydrogen are required during subsequent hydro-reforming stage to produce a crude which can be distilled to gasoline grade hydrocarbons.

In many instances, coal and oil shale contain high levels of sulphur, with coal in particular containing between 0.2 to 7 wt. % sulphur. Consequently, hydrocarbons recovered from such coals or oil shales can have a high sulphur content requiring an extra refining step to remove the sulphur and/or additional emission control equipment on apparatus which burn the hydrocarbons distilled from the crude produced.

Cracking which occurs during the retort process, contributes to the production of crude oils containing high proportions of gasoline grade hydrocarbons from mineral carbon sources being uneconomical. Furthermore, with the possible presence of sulphur in the starting material and consequential levels of sulphur in the hydrocarbons produced even after undergoing subsequent desulphurization, the hydrocarbons produced from coal, oil shale etc. still contain some sulphur which is released as sulphur dioxide when the hydrocarbons are used as a fuel.

Sulphur dioxide released to the atmosphere through the combustion of hydrocarbons is the cause of many environmental problems such as acid rains.

SUMMARY OF THE INVENTION

It is an object of the present invention to provide a process of extracting hydrocarbons from carbon-containing materials such as coal or oil shale which is simple, efficient and economic in its recovery of hydrocarbons. It is preferred that the invention provide a process of extracting hydrocarbons which minimizes and preferably eliminates elemental sulphur or reduced forms of sulphur in the product.

Accordingly the invention provides a process of recovering hydrocarbons from coal or oil shale including the steps of forming a pulp of finely divided coal or oil sale in a first reaction bed, adding concentrated sulphuric acid to said first reaction bed, controlling the temperature of said first reaction bed to produce a hydrocarbon mixture, and deacidifying said hydrocarbon mixture.

Initially, the concentrated sulphuric acid reacts with any water molecules and other components preset in the pulp. For this reason, it is preferable that the sulphuric acid added to the pulp contain little or no water and mono-sulphuric acid is preferred. The reaction of the water with the sulphuric acid goes to completion. The sulphuric acid concurrently reacts with coal or oil shale and destructively degrades the organic structure to produce volatile and non-volatile hydrocarbons. The temperature of the reaction bed is controlled between 70° and 200° C. and preferably up to a maximum temperature above which charring occurs. Typically the temperature will be 180° C. The reaction in the first reaction bed continues until most of the carbon containing material has been converted by acid to the hydrocarbon mixture. The hydrocarbon mixture may include solids, liquids and gases.

As described, the increase in temperature in the reaction bed volatilises the volatile components in the reaction bed and these gaseous volatile components are carried over to a second reaction bed. Since sulphuric acid boils at 338° C., liquid sulphuric acid is carried over with the volatile components to the second reaction bed. Hence the sulphuric acid is preferably recovered from the second reaction bed prior to recovery of the hydrocarbons.

The sulphuric acid oxidises all of the sulphur and reduced sulphur and so all of the sulphur which is carried over is in a chemically bonded form. As such no elemental sulphur or reduced forms of sulphur are present in the second reaction bed.

It is preferable that in the second reaction bed, any volatile components are condensed to form a hydrocarbon mixture and the acid in the hydrocarbon mixture is neutralised.

In a preferred form of recovering the sulphuric acid, metallic iron is used to neutralise any acid carried over in the hydrocarbon mixture. To increase the rate at which the acid is neutralised, the metallic iron may be in a finely divided form such as that produced by electrolysis . The iron reduces the diluted acid in the hydrocarbon mixture to produce iron sulphate and nascent hydrogen. The nascent hydrogen produced is taken up by the hydrocarbons in the hydrocarbon mixture at the same time that the acid in the second reaction bed is be neutralised. To enhance the take up of nascent hydrogen, this hydrogenation step may be conducted at elevated pressures up to about 10 bar.

The hydrocarbons are then recovered as a crude oil which can be later distilled. Substantially, all of the sulphur in the present bed is then chemically bonded as iron sulphate which may be then separated.

The separated iron sulphate solution may be concentrated by crystallization or evaporation of the water in a settling dam and then "roasted" in the presence of oxygen to form iron oxide and $SO_2$. The $SO_2$ is then converted to sulphuric acid and recycled into the process.

By using sulphuric acid to degrade the coal or oil shale to hydrocarbons, the excessive temperatures required in externally heated large scale reactors to retort these materials and extract the hydrocarbons from the material are avoided. This results in less cracking of the volatile hydrocarbons. Furthermore, any organic sulphur often found in carbon containing materials such as coal and oil shale is oxidised and recovered from the hydrocarbons produced without the need for a separate desulphurization step. Levels less than 5 ppm can be achieved. The heat from this oxidation not only can assist in meeting the processes energy requirements but little or no sulphur is recovered wit the hydrocarbons.

Additionally, in a preferred form of recovering the sulphuric acid, the reduction of the sulphuric acid by the metallic iron produces sufficient nascent hydrogen to enable adequate hydrogenation of the extracted hydrocarbons to produce a crude oil which can later be distilled to provide the hydrocarbon fractions which are marketed and used in huge volumes.

In a form of the invention where coal or oil shale is treated in a batch process, the first reaction bed and second reaction beds may be within the same digester. Hence, after the material has been degraded by the acid, the solid residue is separated and the acid recovered in the same reactor. Hydrocarbons may then be separated from the resulting two phase mixture.

In a further form the invention provides a method of increasing the carbon content of coal.

In a still further form the invention provides a method of increasing the carbon or oxygen content of oil shale, coal and the like carbon containing material, while significantly reducing their ash content, the method including the steps described above.

In an alternative form the invention provides a method of treating coal or oil shale or the like including the steps of:

forming a pulp of finely divided coal or oil shale in a first reaction bed, adding concentrated sulphuric acid to said first reaction bed, controlling the temperature of said first reaction bed to produce a hydrocarbon mixture, and deacidifying said hydrocarbon mixture.

DETAILED DESCRIPTION OF THE INVENTION

The features, objects and advantages of the present invention will become apparent from the following description of the preferred embodiment and accompanying drawings.

Figure 1:
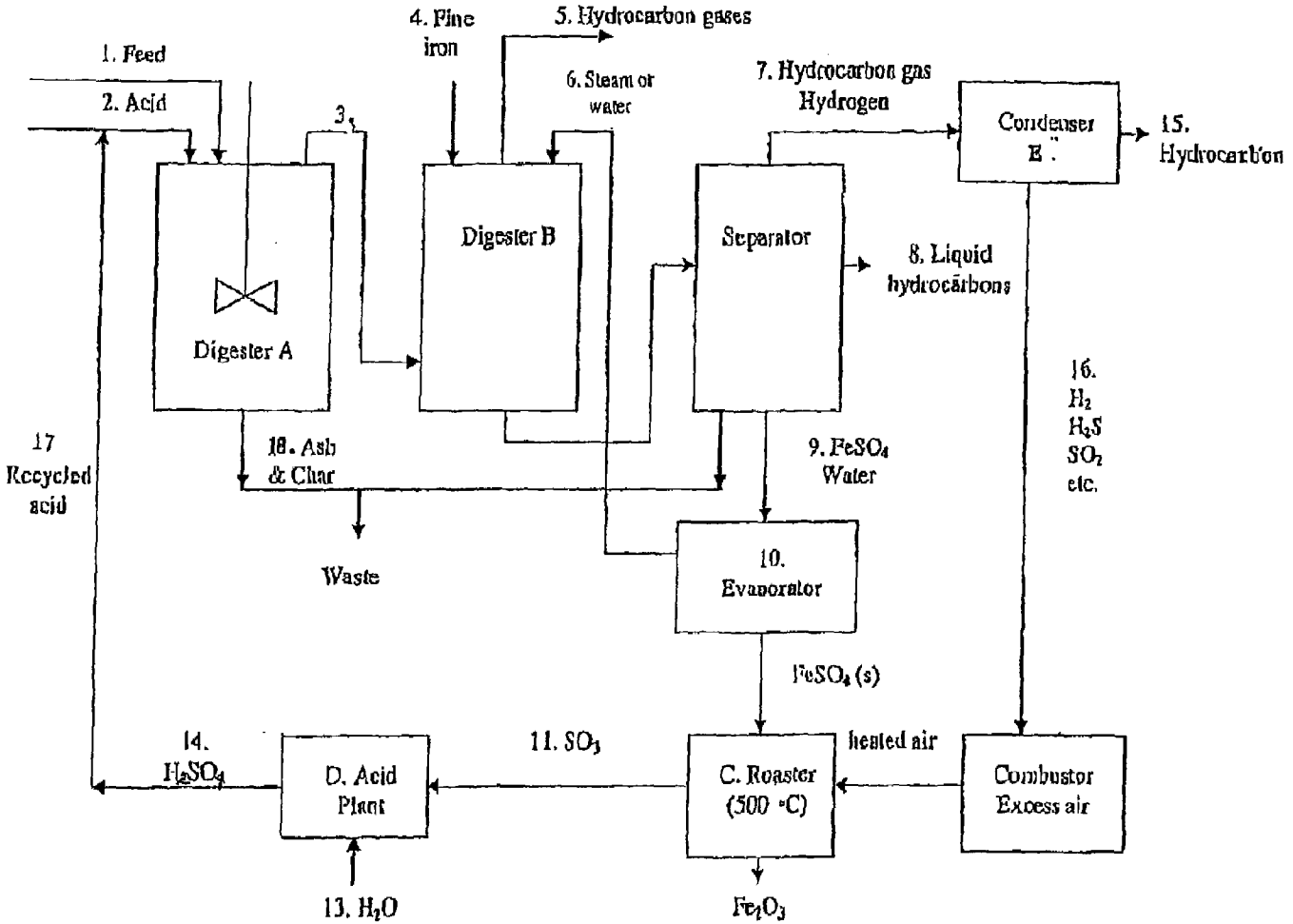
FIG. 1 is a process flow diagram of an embodiment of the invention.

In the extraction and conversion of hydrocarbons from minerals carbon-containing materials such as coal and oil shale, the carbon-containing material is first finely ground in a crusher such as a ball or impact mill and collected in a feed hopper to form a pulp. The finely divided carbon-containing pulp preferably has a minus 100 mesh screen particle size of less than 2 mm. The smaller the particle size of the carbon-containing material, the larger the ratio of surface area to volume and the faster the recovery of hydrocarbons from the material. Referring to FIG. 1, the carbon-containing pulp 1 is then transferred to digester A via a conveying means such as screw feeder which provides a gas seal.

To digester A is added concentrated sulphuric acid 2 preferably mono-sulphuric acid containing little or no water which initially absorbs any water carried into digester A with the finely divided carbon-containing material 1. The reaction bed in digester A is stirred to ensure that all of the pulp is wet and dry pockets of material are avoided.

Some carbon-containing materials such as coal and oil shale contain a high level of sulphur in the form of pyrites $FeS_2$, organic sulphur and as sulphate sulphur. In the case of coal, organic sulphur often comprises 20%–80% of the total sulphur and this sulphur is chemically bound to the coal substance in a complex manner.

The mono-sulphuric acid oxidises the chemically bound sulphur to sulphur dioxide in an exothermic reaction which generates heat to the reaction bed in digester A. The temperature of the reaction bed is gradually increased up to a maximum temperature above which charring occurs of approximately 200° C. but more typically about 130°, the majority of components of the coal or oil shale in liquid form in the reaction bed and acid are swept over with the sulphur dioxide created as a mixture 3 into a second digester B where some of the gases are condensed.

As stated above, when the mono-sulphuric acid is first added to the pulp in digester A, any water present is absorbed by the acid. The mono-sulphuric acid reacts with the oxygen containing functional groups in the oil shale or coal and dehydrates the oxygen groups in the organic structure of the shale or coal. The mono-acid oxidises sulphur and reduced sulphur species to sulphur dioxide which initially sweeps the liquid components with the volatile components of the pulp into the second digester B used to contain these gases and other components. In the first digester the acid also attacks the cellulose and other carbon-containing material which is contained in the coal or oil shale producing paraffins and smaller chain hydrocarbons. The degradation of shale or coal to produce hydrocarbons may occur through a combination of hydrolysis and dehydration of the oxygen functional groups (eg esters and carboxylic acids, phenolics) and the sulphonation of the aromatic and aliphatic carbon.

The acid also reacts to oxidise the chemically bound sulphur to $SO_2$ releasing energy. As the reaction bed temperature reaches and increases above 100° C., water is boiled out of the system as steam. The volatile components from the coal or oil shale tend initially to be released from the solid pulp between about 70° C. and 200° C. Most of the hydrocarbons have been reacted by the time the temperature of the reaction bed reaches between 160° C. and 180° C. To prevent cracking and charring of the hydrocarbons resulting from the degradation of the carbon-containing material by the acid, it is preferable that the temperature of the sedation bed in digester A is maintained below the temperature at which charring occurs. It is generally controlled to be less than about 200° C. preferably less than 180° C. and more typically 130° C. This is achieved by controlling the heat supplied to the first reaction bed in digester A.

Once the reaction in the first digester A has oxidised the pulp in the reaction bed, more mono-acid may be added and the boiling action continued until there is nothing left in the first digester except an ash and acid. The ash remains as a white solid residue and may be discarded as stream 15. The hydrocarbons produced and other liquids in the first digester will have then been carried over with the other created gases into the second digester B.

This stage of the process may be carried out on a continuous basis by continually supplying carbon-containing material and mono-sulphuric acid to the first digester so that hydrocarbons are continuously produced and carried over to the second digester B.

In the second digester B, the gaseous mixture of hydrocarbons, acid, $SO_2$ and $SO_3$ are preferably condensed and the lighter hydrocarbons which do not condense, are removed. No elemental sulphur or non oxidized sulphur is present in the second digester B. Those which do not condense are removed, stream 5.

Since the hydrocarbons are not soluble in the sulphuric acid the acid may be separated from the hydrocarbons and the hydrocarbons 8 subjected to an hydrogenation treatment to combine the hydrocarbons resulting from the degradation of the carbon-containing material to form a liquid crude oil product Alternatively, the acid may be recovered from the hydrocarbon mixture condensed from the feed to digester B by passing the mixture through a centrifuge to remove the excess acid which may be recycled back to digester A. The mixture is then contacted with water 6 and metallic additive 4 such as iron. Excess metallic iron may be added to the second digester B to neutralise the acid. Since the particle size of the metallic iron determines the rate of neutralisation of the acid, the metallic iron is preferably added in a finely divided state.

Iron preferably reduced by carbon monoxide from its ores magnetite, hematite, etc. can be produced in a finely divided state as sponge iron and this iron is the preferred form of metallic iron to be added to the second digester B. The carbon monoxide can be produced by any known method.

With the material in the second digester B, distilled water or steam 6 may be added to the very acidic second reaction bed. The water 6 added to the second reaction bed preferably does not contain any air or nitrogen. The metallic iron reacts with the water and acid in the second digester B to produce iron sulphate and hydrogen in a nascent state.

The nascent hydrogen hydrogenates the unsaturated hydrocarbons and remove oxygen, nitrogen and sulphur from the hydrocarbons. To enhance the hydrogenation of the hydrocarbons, the reaction bed may be operated at elevated pressure.

Once all of the acid in the second digester B has been neutralised, the addition of metallic iron ceases and a substantially two phased liquid mixture remains. One phase containing water and dissolved iron sulphate while the other phase contains the hydrocarbons. The liquid hydrocarbons may be separated as stream 8 and then be used as a crude oil feed and fractionally distilled to useable liquid petroleum products. The gaseous hydrocarbons separated from the hydrocarbon stream may be passed through a condenser E to condense where possible lighter end hydrocarbons 15 from the gaseous $H_2$. $SO_2$ $H_2S$ etc. components 16. These components 16 may be mixed with the air for the roasting of the iron oxide to produce $SO_2/SO_3$ and ultimately $H_2SO_4$.

The iron sulphate stream 9 in the aqueous solution contains substantially all of the sulphur and reduced sulphur contained in the coal or oil shale and sulphuric acid.

The aqueous iron sulphate solution may be processed in a number of conventional processes to recover either sulphur or sulphuric acid. For example, if the water is evaporated in evaporator 10 and the remaining iron sulphate 9 heated in an oxygen atmosphere up to 500° C. in a furnace C, then $SO_3$ gas 8 is given off leaving iron oxide in the roaster C. Then $SO_3$ gas 11 is given off and can be then absorbed into water 13 in an acid plant D to form sulphuric acid 14 which is then recycled and combined with stream 2 and fed as stream 12 into digester A. Thus, the resulting hydrocarbons arc substantially sulphur free. When these hydrocarbons are then used as a fuel, the fuel is substantially free of sulphur and does not require additional desulphurisation process.

Additionally, it is an attribute of this process that because it is operating at less temperate, it will use less energy than conventional retorting processes.

If the production of hydrocarbons from carbon-containing material is being carried out in a batch process, the degradation of the material and the recovery of sulphuric acid may be carried out in a single digester preferably under sufficient pressure to enable the hydrocarbons released and produced to hydrogenate. Upon completion, once the solid phases have been separated from the liquid phases, the aqueous iron sulphate phase and hydrocarbon phase can be separated and treated in the same way as each phase is treated in the continuous operation.

Alternatively, the process may be adapted for continuous operation by pumping the acid/slurry through a plug flow heat exchanger acting as digester A into the second digester for neutralisation of the acid with iron. In this way, the temperature of acid/shale slurry could be regulated much more easily preventing undesirable effects such as charring occurring if the mixture gets too hot.

The digesters used for the process in accordance with the invention are generally constructed from suitably resistant materials.

It should be apparent to a person of ordinary skill in the art that the above treatment of coal or oil shale base can be effectively treated in a destructive distillation process using concentrated sulphuric acid preferably mono sulphuric acid to produce a hydrocarbon mix which can be used as a substitute for crude oil. This crude oil substitute may be then fractionally distilled to produce useable hydrocarbons in the usual manner.

The invention will be further illustrated by reference to analysis of material treated according to the present invention.

Stage 1

Shale and coal samples were ground to less then 125 $\mu$m. Each sample was placed in a glass beaker and concentrated sulphuric acid was added with constant stirring (shale/coal to acid ratio 1:3). Stirring was continued for 5 minutes. The mixture was then heated on an electronic hot plate to 120° C. with constant mixing. The sample was then cooled and centrifuged to remove excess acid.

Samples for differential thermal analysis (DTA) and pyrolysis-gas chromatography mass spectroscopy (py-GC/MS) analysis were thoroughly water washed till the filtrate pH was greater than 5.

Stage 2

Samples of the above treated product were placed in a 300 ml stainless steel autoclave and additional water added to dilute the slurry. Iron (in the form of steel wool) was added to the autoclave and sealed. The samples were allowed to react over night. After the initial reaction of the iron additional steel wool was added to the mixture till all of the acid was consumed. The reacted products were then filtered.

Samples of gas from the autoclave were collected to determine if sulphur species were liberated during the reaction.

Complete neutralisation of the sulphuric acid to iron sulphate was also observed in the second stage of the process with stoichiometric quantities of hydrogen produced.

Solid residue materials were analysed by py-GC/MS to determine the characteristics of the material.

Thermal and chemical analysis of the first stage products showed that the acid treatment significantly altered the chemical composition of the test materials. A summary of the chemical analysis is given in Table 1.

TABLE 1

Chemical Composition of Material Investigated

| Sample | C (% db) | H (% db) | N (% db) | S (% db) | O* (% db) | Atomic H/C ratio | Ash (% db) |
|---|---|---|---|---|---|---|---|
| Raw Shale | 7.7 | 1.9 | 0.22 | 0.13 | 12.1 | 2.96 | 78 |
| Acid Treated Shale | 36.2 | 1.3 | 0.73 | 1.4 | 24.8 | 0.43 | 35.5 |
| Raw Coal | 74.9 | 5.3 | 1.52 | na | 3.9# | 0.85 | 14.4 |
| Treated Coal | 61.6 | 4.3 | 1.39 | 3.99 | 22.2 | 0.83 | 6.5 |
| Treated Coal ($H_2SO_4$ free basis) | 68.9 | 4.6 | 1.70 | 0.55 | 17.7 | 0.80 | 6.5 |
| Treated Coal (heated to 200° C.) | 62.0 | 2.1 | 1.50 | 2.63 | 24.6 | 0.41 | 7.2 |

*determined by difference
#oxygen + sulphur
na not available.

Acid treatment of the coal and shale significantly reduced the ash content of the sample. The oxygen content of coal and shale samples was found to increase significantly, suggesting that oxygen has been incorporated into the organic structure. Significant charring of the samples is also evident. The sulphur content of the samples increased with the acid treatment, although it is not clear if this is at least in part due to possible incomplete removal of the acid.

Differential thermal analysis of the raw shale shows that decomposition and volatilisation of the shale occurs in the temperature region 420 to 550° C. The acid treated sample shows significant volatilisation of material across a temperature range of 30 to 650° C. The total weight loss was 30% for the acid treated material (10% below 180° C.) compared to 19% for the raw shale. The DTA-TG profile also showed that significant "charring" of the sample had occurred during the acid treatment.

The DTA-TG analysis of the coal was similar to that of shale, with approximately 10% of the material volatilising below 200° C. for the treated coal sample. Charring of the sample was also evident in the coal sample. Comparison of the chemical analysis of the acid treated coal, which was heated to 200° C. and the acid treated shale showed that the material volatilised was composed of carbon, hydrogen and sulphur, presumably a sulphonated hydrocarbon.

The results of thermal and chemical analysis of the Stage 1 products has shown that the acid treatment of coal and shale significantly breakdown the structure of the material and produce (or release) volatile material.

The results of the thermal analysis of the first stage products indicated that significant amounts of volatile material were produced from the acid treatment of shale and coal. Pyrolysis gas chromatography-mass spectroscopy (py-GC/MS) was used to determine the composition of the Stage 1 and Stage 2 process products.

Samples of first stage products were extensively water washed to remove the sulphuric acid. The water washing procedure was the same as that used to remove the acid for the thermal analysis and it is believed that any aliphatic/aromatic hydrocarbons would not have been removed. The solid products were then dried under vacuum at 20° C. The solid products we then analysed by sequential gas chromatography mass spectroscopy (py-GC/MS).

In all cases very low quantities of volatile material was observed for the first stage solid products. However, pyrolytic material which was aromatic in nature and contained very little aliphatic material was observed.

Significant amounts of carbon were observed in the water washings, however, no quantification was performed to determine the exact amount of carbon present and no analysis was performed to identify the composition of the carbonaceous material.

Figure 2:
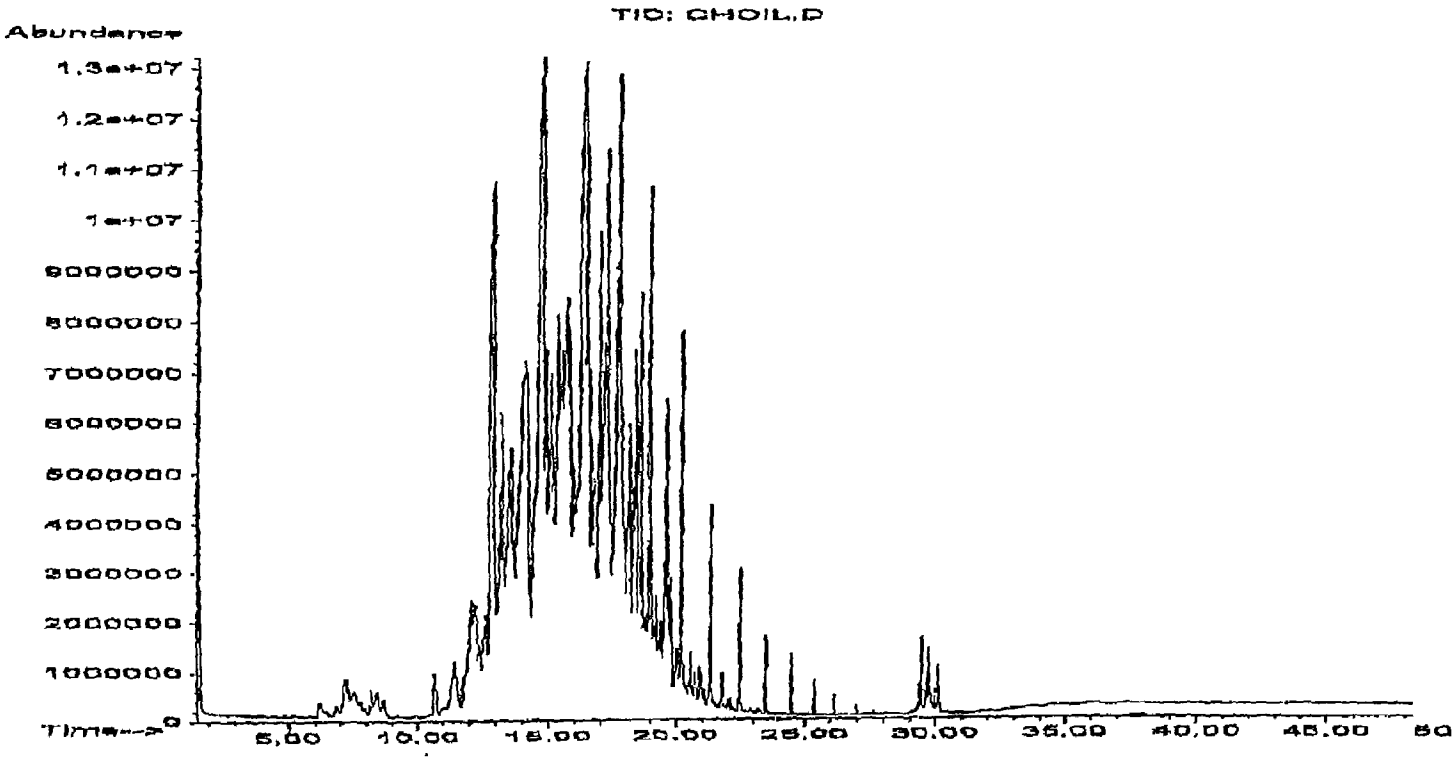
FIG. 2 is a graph illustrating a GC/MC analysis of hydrocarbon fraction from the acid treatment process of the invention.

Gaseous samples collected at the completion of Stage 2 reactions for the shale were analysed using "Drager Tubes" for $SO_2$ and $H_2S$ No detectable quantities were observed (i.e. less than 5 ppm). It i likely that $SO_2$ and ($SO_3$) and $H_2S$ are produced during the reaction, however, the gases would readily dissolve in the acid/water mixture. Complete neutralisation of the sulphuric acid to iron sulphate was also observed Treatment of a further sample of oil shale has yielded hydrocarbon materials primarily in the range $C_{10}$–$C_{20}$ with carbon content of 87% and hydrogen content of 13% and less than 0.2% sulphur. A GC/MC analysis of hydrocarbon fraction from the acid treatment is illustrated in FIG. 2.

What is claimed is:

1. A process of producing hydrocarbons from a coal, lignite, or oil shale and the like carbon and sulfur containing materials including the steps of forming a pulp of finely divided carbon-containing material in a first reaction bed, adding concentrated mono sulphuric acid to said first reaction bed, to degrade the carbon and sulfur containing material in the first reaction bed to hydrocarbons and a solid residue, controlling the temperature of said first reaction bed to between 70° C. and 200° C. to produce a hydrocarbon mixture, and deacidifying said hydrocarbon mixture by the steps including combining finely divided iron and water with the hydrocarbon mixture, the metallic iron combining with the residual acid in the hydrocarbon mixture to form a neutralized liquid hydrocarbon mixture.

2. The process of claim 1 wherein the reaction bed temperature increases up to between 160° C–180° C.

3. The process of claim 1 wherein the hydrocarbon mixture has a boiling point in the range of 150° C.–350° C. and is predominantly aliphatic.

4. The process of claim 1 wherein the solid residue is separated from the hydrocarbon mixture prior to recovery of the sulphuric acid in said hydrocarbon mixture.

5. The process in accordance with claim 1 wherein the hydrocarbon mixture is hydrogenated prior to recovery of hydrocarbons, from said hydrocarbon mixture.

6. The process according to claim 1 wherein the metallic iron is in a finely divided form.

7. The process of claim 6 wherein the metallic iron combines with the residual acid to produce iron sulphate and nascent hydrogen and wherein the $SO_2$ and $H_2S$ emissions are below 5 ppm.

8. The process of claim 7 wherein the nascent hydrogen hydrogenates the hydrocarbons produced from the degradation of the carbon-containing pulp to form a hydrocarbon product.

9. The process of claim 7 wherein the iron sulphate is separated from the hydrogen and hydrocarbon mixture and heated to a temperature of approximately 400° C. in the presence of oxygen to produce gaseous sulphuric acid.

10. The process of claim 9 wherein the gaseous sulphuric acid is condensed and recycled for addition to the pulp of finely divided carbon.

11. The process in accordance with claim 1 wherein the recovery of sulphuric acid and hydrogenation of the hydrocarbons resulting from the degradation of the carbon-containing material occurs in a second reaction bed.

12. The process of claim 1 wherein the hydrocarbons are further hydrogenated to produce a liquid crude oil product substantially free of sulfur.

13. A method of increasing the carbon or oxygen content of oil shale, coal and the like carbon containing material, while significantly reducing their ash content by the combination of the steps in claim 1.

* * * * *